US008407967B2

(12) United States Patent
Brindle, Jr.

(10) Patent No.: US 8,407,967 B2
(45) Date of Patent: Apr. 2, 2013

(54) APPARATUS AND METHOD FOR AN ADJUSTABLE COLUMN

(76) Inventor: David R. Brindle, Jr., Holbrook, NY (US)

( * ) Notice: Subject to any disclaimer, the term of this patent is extended or adjusted under 35 U.S.C. 154(b) by 91 days.

(21) Appl. No.: 12/156,155

(22) Filed: May 29, 2008

(65) Prior Publication Data

US 2009/0293422 A1 Dec. 3, 2009

(51) Int. Cl.
*E04C 3/00* (2006.01)

(52) U.S. Cl. ..... 52/854; 52/831; 52/126.7

(58) Field of Classification Search ..... 52/854, 52/855, 831, 745.17, 126.7, 296; 248/161, 248/405; 254/102
See application file for complete search history.

(56) References Cited

U.S. PATENT DOCUMENTS

| | | | | | |
|---|---|---|---|---|---|
| 1,547,175 | A | | 7/1925 | Lally | |
| 1,571,091 | A | | 1/1926 | Lally | |
| 1,625,899 | A | | 4/1927 | Lally | |
| 2,280,220 | A | * | 4/1942 | Crosby | 52/126.6 |
| 2,763,342 | A | | 9/1956 | French | |
| 2,943,716 | A | | 7/1960 | Babcock | |
| 3,521,413 | A | | 7/1970 | Scott et al. | |
| 3,630,474 | A | | 12/1971 | Minor | |
| 3,671,738 | A | | 6/1972 | Beachley | |
| 3,837,752 | A | | 9/1974 | Shewchuk | |
| 3,967,906 | A | | 7/1976 | Strizki | |
| 4,007,564 | A | | 2/1977 | Chisholm | |
| 4,217,738 | A | | 8/1980 | Smith | |
| 4,295,308 | A | | 10/1981 | Korfanta | |
| 4,590,719 | A | | 5/1986 | McKibbin | |
| 4,878,160 | A | | 10/1989 | Reneau et al. | |
| 4,926,592 | A | | 5/1990 | Nehls | |
| 5,056,750 | A | * | 10/1991 | Ellithorpe | 248/354.3 |
| 5,156,395 | A | | 10/1992 | Smith | |
| 5,505,033 | A | | 4/1996 | Matsuo et al. | |
| 5,660,362 | A | | 8/1997 | Selby et al. | |
| 5,772,356 | A | * | 6/1998 | Collins | 403/343 |
| 5,855,443 | A | | 1/1999 | Faller et al. | |
| 5,878,540 | A | | 3/1999 | Morstein | |
| 6,820,389 | B1 | | 11/2004 | Macchietto | |
| 6,868,641 | B2 | | 3/2005 | Conner et al. | |
| 7,677,522 | B2 | * | 3/2010 | Bakos | 248/500 |
| 2005/0045784 | A1 | | 3/2005 | Pitlor | |

* cited by examiner

*Primary Examiner* — Jeanette E Chapman
*Assistant Examiner* — Daniel Kenny
(74) *Attorney, Agent, or Firm* — Harold G. Furlow, Esq.

(57) ABSTRACT

An adjustable lally column apparatus is described which includes a column, a cap plate and an adjustment mechanism. The cap plate is connected to the column and fasteners are connected to an external beam. The integrated cap plate and column assembly are connected to the fasteners in the beam and the column is suspended from the fasteners. The adjustment mechanism is connected to the column and adjusted to provide a load bearing interface between a floor and the column. A method of adjusting a column includes employing a single person to connect the cap plate and adjustment mechanism, elevating the column to the vertical and using a lever to lift the integrated column and cap plate and connecting the assembled column and cap plate to the beam. The adjustable column is secured to the beam using the fasteners. The adjustment mechanism is connected to a floor and adjusted to place the adjustable column in a load bearing position between the beam and the floor.

12 Claims, 6 Drawing Sheets

APPARATUS AND METHOD FOR AN ADJUSTABLE COLUMN

BACKGROUND OF THE INVENTION

1. Field of the Invention

The present disclosure relates to columns used to support structures and in particular to lally columns that can be adjusted in height.

2. Description of the Related Art

Permanent structural columns, such as lally columns, are often pre-fabricated and cut to size at the construction site to fit the actual height needed for a particular application. The cutting, assembling and installing of the column is a time consuming process that can undesirably require specialized tools and skilled labor.

Adjustable columns that have been developed to address this problem are typically telescopic in nature with a first tubular post sliding within a second tubular post. A cross-bar is inserted through holes aligned in the first and second posts to fix the height of the column. A cap plate is connected to a threaded bar and the bar is then rotated to elevate the cap plate for the final height adjustment. These adjustable columns, however, can be load limited compared to traditional lally type columns and are vulnerable to tampering. Alternative adjustable columns insert one or more shim plates at the base to increase the height of the column while the column is manually held upright for connection with pre-existing apertures in a beam. Both of these configurations require multiple personnel to retain the column in position while the height of the column is adjusted and the alignment secured.

Columns have traditionally been assumed to support a load that also provides an adequate counterforce against uplifting forces. This tradition is incorporated into many residential and commercial building codes by the omission of a requirement that columns connect to the floor and supported beam. As a result, in many installations columns are simply placed in a load bearing position without being positively secured to the floor and beam. A secure connection between the column, floor and beam that can provide the uplift protection is being increasing recognized as an important structural element under severe weather or environmental conditions.

An adjustable column is needed that can be readily installed by a single worker with the use of readily available tools that can also advantageously provide uplift protection.

SUMMARY OF THE INVENTION

An adjustable lally column is described that comprises a lally column that has a first end portion and an opposed second end portion, a cap plate and a retention mechanism. The cap plate has a first side that connects to the first end portion and an opposed side that is adapted to connect to a beam. The cap plate includes means for the selective retention of the cap plate. An adjustment mechanism includes a base plate and connects to the second end portion of the column. The base plate is adapted to be positioned on a floor.

A first position of the adjustable column that includes a support structure connected to an external beam and the cap plate connected to the first end portion of the column. The integrated column and the cap plate connected to the support structure using the means for the selective retention of the cap plate. The integrated cap plate and column are suspended in the first position from the connection of the cap plate to the beam.

A second position wherein the adjustment mechanism is connected to the second end portion of the column and provides an adjustable load bearing interface between the floor and a terminal end of the second end portion of the column, the adjustment mechanism moves the column between the suspended position and a load bearing position between the beam and the floor.

The first position can further include the alignment of the base plate with the support structure connected to the beam and the securing of the base plate to the floor. The first side of the cap plate includes a nut and the column includes an anchor bolt. The nut and anchor bolt connect to secure the cap plate to the column. The adjustment mechanism includes a base flange that connects to the second end portion and at least one threaded adjustment fastener is threadingly connected to the base flange. The adjustment fastener adjusts the distance between the base plate and base flange and provides a load bearing interface between the base flange and base plate.

The adjustment mechanism includes a base flange and a plurality of threaded adjustment fasteners. At least two threaded adjustment fasteners connect the base flange and base plate and at least two threaded adjustment fasteners adjust the distance between the base flange and the base plate. The adjustment mechanism can also include a base flange and a plurality of threaded adjustment fasteners that connect to the base flange and the distal ends of each of the threaded adjustment fasteners is positioned in a notch on the base plate. The threaded adjustment fasteners can extend through the base plate and configured to connect to the floor.

The adjustment mechanism further includes a sleeve and a set of discs. The sleeve defines an aperture that receives the column and connects to the base plate. The set of discs is selectively positionable between a terminal end of the second end portion of the column and the base plate. The set of discs provides a load bearing connection between the column and base plate.

The base plate and base flange can be connected by a band that connects the base plate and base flange. The adjustment mechanism is adapted to be embedded in concrete. The uplift protection of the adjustable column can be provided by fasteners that extend through apertures in the base plate and into the floor and fasteners that extend through apertures in the cap plate and into the beam.

A method of adjusting the height of a column is described comprising the steps of providing a column, a cap plate and an adjustment mechanism, connecting a first end portion of the column to a cap plate, connecting fasteners to a beam, connecting the integrated column and cap plate to the fasteners and suspending the column from the fasteners. The method also includes connecting the adjustment mechanism to a second end portion of the column and adjusting the height of the adjustment mechanism such that the adjustment mechanism moves the column between a suspended position and a load bearing position between the beam and floor.

The method of adjusting the height of a column can include a single worker performing the steps of connecting, raising and adjusting the height of the adjustment mechanism. The step of adjusting the height of the adjustment mechanism further includes adjusting the height between a base flange and a base plate of the adjustment mechanism using threaded load bearing fasteners. The step of adjusting the height includes connecting a base flange to the second end portion of the column and connecting at least one load bearing fasteners to the base flange and the base plate to adjust the height of the adjustment mechanism to place the adjustable column in the load bearing position.

The step of adjusting the height includes connecting a base flange to the second end portion of the column and threading at least one load bearing fasteners to the base flange. This step can further include the positioning of a second end of the load bearing fastener in a notch of the base plate to adjust the height of the adjustment mechanism to place the adjustable column in the load bearing position.

The step of adjusting the height of the adjustment mechanism further includes providing a base plate, a sleeve and a set of discs and adjusting the height of the adjustment mechanism by selectively inserting one or more discs of the set of discs between a terminal end of the second end portion of the column and the base plate. The step of connecting the adjustment mechanism to the second end portion includes slidingly positioning the sleeve on the column. The step of adjusting the height of the adjustment mechanism further includes securing the sleeve to the base plate and the column. The step of adjusting the height of the adjustment mechanism further includes encapsulating the adjustment mechanism in a layer of concrete.

BRIEF DESCRIPTION OF THE DRAWINGS

Preferred embodiments of the invention are described below with reference to the drawings, wherein like numerals are used to refer to the same or similar elements.

DETAILED DESCRIPTION OF THE INVENTION

Figure 1:
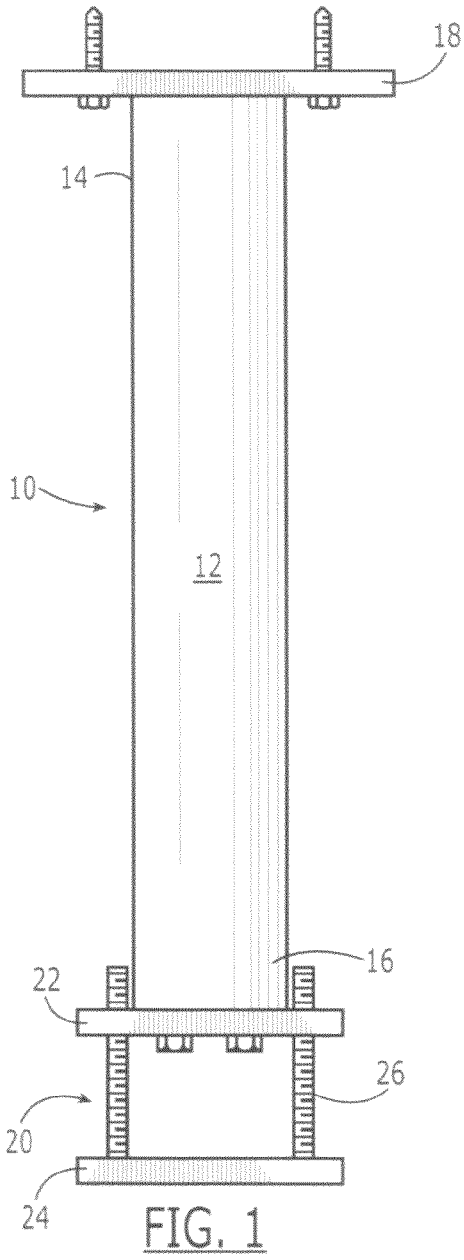
FIG. 1 is a front view of an adjustable column that includes a column, a cap plate and an adjustment mechanism, the adjustable column constructed in accordance with the present disclosure.

Referring initially to FIG. 1, an apparatus for an adjustable column 10 includes an elongate column 12 that has a first end portion 14 and an opposed second end portion 16, a cap plate 18 and an attachment mechanism 20. First end portion 14 connects to cap plate 18 and second end portion 16 connects to adjustment mechanism 20. Column 12 defines a central longitudinal axis and preferably has a cylindrical shape. In this preferred embodiment, column 12 is an exemplary lally type column.

Figure 2:
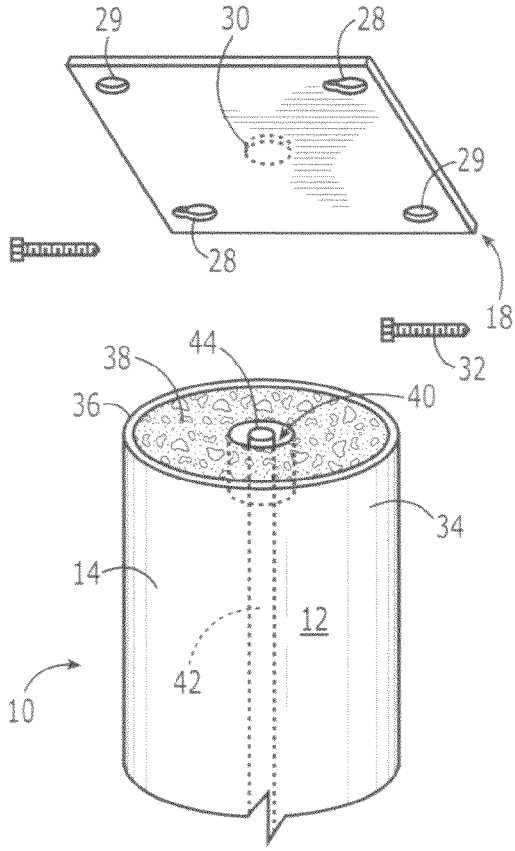
FIG. 2 is a top and side perspective view of a first end portion of the column and a perspective view of a first side of the cap plate of the adjustable column of FIG. 1.

As shown in FIG. 2, cap plate 18 is a planar shaped plate that defines at least two key hole type apertures 28 that are selective retention mechanisms for cap plate 18 with fasteners 32. In addition, cap plate 18 can selectively define one or more apertures 29 that are cylindrical shaped through holes. A receptacle or nut 30 is connected to a first side of cap plate 18. In this preferred embodiment, nut 30 interfaces with an anchor bolt 42 that is preferably a ½ inch diameter threaded bolt. The opposing side of cap plate 18 is adapted to interface with an external structure. In this preferred embodiment, cap plate 18 is an approximately 5⅜ inches wide, approximately eight (8) inches long and approximately ¼ of an inch thick plate.

Key hole apertures 28 have a first portion and a second portion. The first portion of each aperture 28 has a first cross-sectional area parallel to the plane defined by plate 18 that tapers or reduces to a second portion with a second cross-sectional area parallel to the plane of plate 18 in the second portion. The first portion of aperture 28 has a larger cross-sectional area than the cross-sectional area of the second portion. Bolts 32 have heads that will fit through the first portion, but cannot fit through the reduced area of the second portion of key hole apertures 28. Key hole apertures 28 are preferably aligned in a single direction, but it is understood that apertures 28 can have any directional alignment that facilitates the securing and retaining of cap plate 18 to the external structure.

Alternative equivalents of the selective retention mechanism of cap plate 18 or means for selectively retaining plate 18 with fasteners 32 includes configurations in which select apertures in cap plate 18 allow the passage of a head of fastener 32 and a slotted washer, pin and/or slotted plate is positioned between cap plate 18 and the head of fastener 32 to retain cap plate 18 with the head of fastener 32.

Column 12 is preferably a lally type column that has a steel outer tube 34 that defines a rim 36 that is a portion of the terminal end of first end portion 14 of column 12. Column 12 includes a concrete filling 38 with a terminal end that is approximately flush with rim 36. First end portion 14 includes a notch or aperture 40 in an outwardly directed face of the terminal end of concrete 38 that extends a predetermined distance along and is aligned with the central longitudinal axis of column 12. An anchor bolt 42 is positioned in concrete filling 38 that extends into notch 40 and in the opposing direction along the central longitudinal axis towards second end portion 16. Column 12 has an outside diameter in this exemplary preferred embodiment that is approximately four (4) inches in diameter.

Notch 40 has a depth along the central longitudinal axis and cross-sectional area perpendicular to the longitudinal axis that receives nut 30 of plate 18. Bolt 42 has a first terminal end 44 that is approximately aligned with rim 36 of tube 34. Anchor bolt 42 and nut 30 secure the first side of cap plate 18 in direct contact with the terminal end of first end portion 14. Anchor bolt 42 provides the structural integrity necessary for bolt 42 to provide uplift protection and at least support the weight of adjustable column 10.

Figure 3:
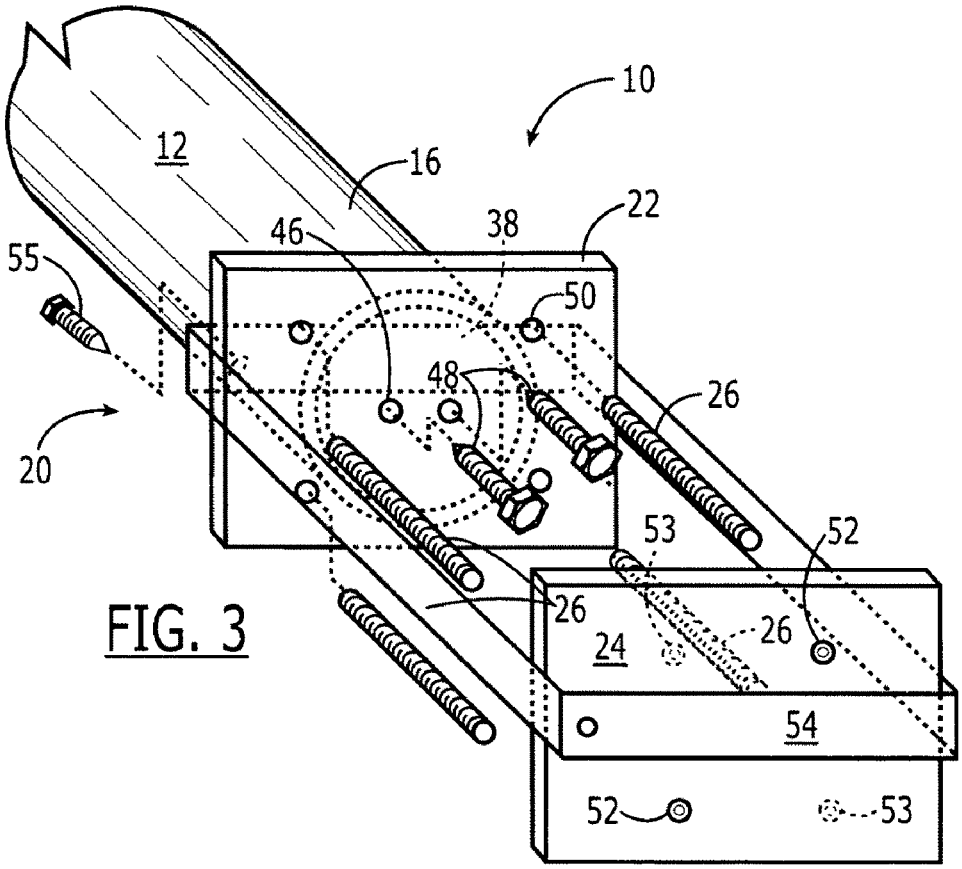
FIG. 3 is a bottom and side perspective view of a first embodiment of the adjustment mechanism of the adjustable column of FIG. 1.

Referring now to FIGS. 1 and 3, in this preferred embodiment of adjustment mechanism 20 includes a base flange 22, a base plate 24 and four load bearing fasteners 26. Base flange 22 connects to second end portion 16 of column 12. Base flange 22 preferably defines two apertures 46 that receive concrete screws 48 that secure base flange 22 to concrete filling 38 of the terminal end of second end portion 16. It is understood that alternative methods of connecting flange 22 and column 12 include those commonly used in the industry such as welding, adhesives and/or an anchor bolt, for example.

Base flange 22 has four apertures 50 that are in close proximity to the outer surface of column 12. Apertures 50 have an equidistant arrangement that form a square around column 12. Each fastener 26 has a head and an opposed distal or second end. Each fastener 26 is preferably a hardened set screw suitable for load bearing applications of adjustable column 10 and to provide for the relative movement between base flange 22 and base plate 24. Fasteners 26 preferably have a diameter of ½ inch and a length of approximately 3½ inches.

Continuing with this preferred embodiment, base plate 24 includes two diagonally opposed apertures 52 and two diagonally opposed notches 53 that are aligned with apertures 50. Fasteners 26, apertures 50, apertures 52 and notches 53 are aligned with the central longitudinal axis. Apertures 52 can be through holes or terminate in plate 24. Two fasteners 26 are connected to both threaded apertures 50 in base flange 22 and threaded apertures 52 in base plate 24 to securely couple base flange 22 to base plate 24. The remaining two fasteners 26 are connected to threaded apertures 50 and the distal end of each fastener 26 is positioned in one of notches 53. Notches 53 are non-threaded depressions in plate 24 that are sized and dimensioned to receive the second end of fasteners 26.

Uplift protection for adjustable column 10 is provided by securing attachment mechanism 20 to an external structure. Fasteners such as concrete screws 48 connect to the external structure through additional apertures in base plate 24. Fasteners 26 can also extend through apertures 52 in base plate 24 and have terminal ends suitable to connect with an external structure.

In a variation of the first embodiment of adjustment mechanism 20, base plate 24 includes four notches 53 that receive the second ends of fasteners 26. This variation provides an increased ability to compensate for angular variations in the external surface upon which base plate 24 is positioned. Base plate 24 is connected to base flange 22 by a band 54. In this variation, band 54 preferably extends under base plate 24 and is secured to base flange 22 using screws 55. Band 54 is preferably metal, but band 54 can be fabricated of alternative materials such as composites, polymers and fiberglass, for example, that connect base flange 22 and base plate 24 together in a secure load bearing position.

Figure 6:
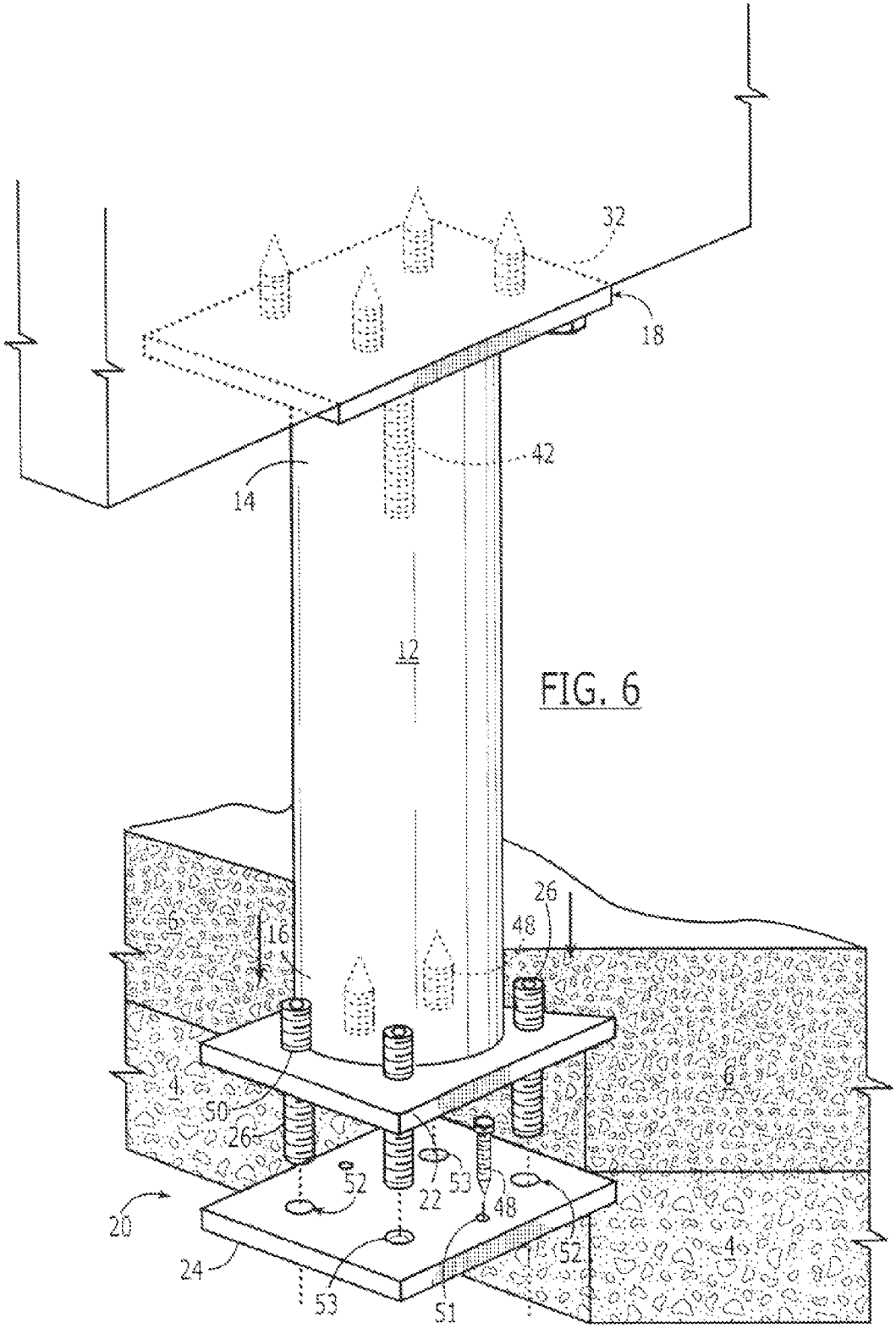
FIG. 6 is a close-up front and downwardly directed perspective view of the adjusting of the height of the adjustable column of FIG. 1 into a load bearing position.

Continuing with this variation of the first embodiment, uplift protection is provided by the embedding of adjustment mechanism 20 in a layer of poured concrete such as concrete floor 6 (see FIG. 6). Uplift protection can be also provided by using one or more concrete screws, such as fasteners 48 through additional holes in plate 24 and/or band 54 and into an external surface such as sub-floor 4, for example (see FIG. 6).

Figure 4:
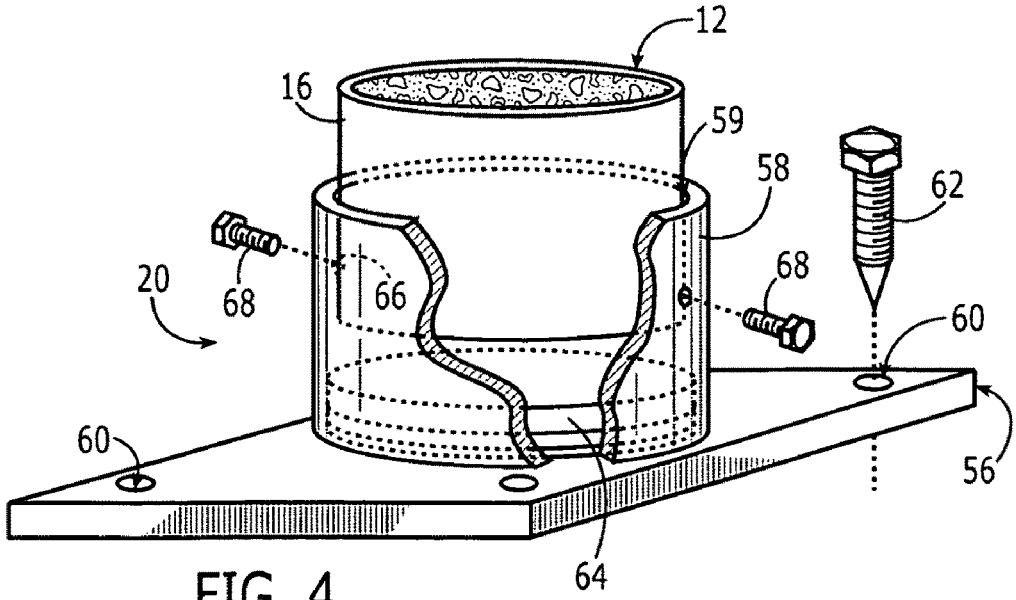
FIG. 4 is a side and top perspective view of a second embodiment of the adjustment mechanism of the adjustable column of FIG. 1.

As shown in FIG. 4, a second preferred embodiment of adjustment mechanism 20 includes a base plate 56 and a sleeve 58. Plate 56 has two or more apertures 60 that receive fasteners 62, such as concrete screws that connect plate 56 to an external surface for uplift protection. Sleeve 58 connects to base plate 56 and defines an aperture 59 that receives column 12.

The second embodiment of adjustment mechanism 20 also includes a set of discs 64 that has a plurality of individual discs that range in thickness between approximately 1/16 of an inch and approximately one (1) inch. Set of discs 64 preferably has planar parallel opposing faces and an outside diameter that is approximately equivalent to the outside diameter of column 12. At least one of set of discs 64 is selectively positioned on base plate 24 to provide a continuous load bearing interface between the terminal end of second end portion 16 of column 12 and base plate 56. A recess is preferably defined in base 56 that receives and aligns the initial disc of set of discs 64 with the connection for sleeve 58.

Sleeve 58 connects to second end portion 16 of column 12 and flange 56 to align column 12 with set of discs 64 and create an integrated assembly of attachment mechanism 20 and column 12. Sleeve 58 encloses set of discs 64 between base plate 56 and the terminal end of second end portion 16 of column 12. Sleeve 58 can connect to base plate 56 and column 12 using any means of mechanical connection that provides adequate uplift protection. In this preferred embodiment, sleeve 58 is secured to column 12 by at least one aperture 66 in sleeve 58 that receives a fastener 68 that extends through tube 34 and into concrete filling 38.

Base plate 56 preferably has dimensions of approximately 5¾ by 8 inches and a thickness perpendicular to the longitudinal axis of approximately ⅜ of an inch. Sleeve 58 has a height along the longitudinal axis of approximately four inches and a thickness perpendicular to the longitudinal axis of approximately ¼ inch. Aperture 59 of sleeve 58 has an inside diameter of approximately four (4) inches that receives a four (4) inch diameter lally column 12. It is understood, however, that these dimensions are variables that are situational dependent upon interfacing with a given dimension of column 12 for a specified structural application.

Referring to FIGS. 3 and 4, adjustment mechanism 20 preferably has a range of adjustability that is adapted to a particular column 12 and load capacities. For example, in one preferred embodiment, columns 12 can be procured in lengths that vary by three inches. The adjustable range of extension or adjustment mechanism 20 in this example is approximately 3 inches depending upon factors such as the thickness of base flange 22 and which embodiment is employed.

Cap plate 18, base flange 22, base plate 24 and base plate 56 are preferably planar shaped steel plates that can be dimensioned to a particular application and to increase the level of uplift protection. For example, increasing the dimensions of base flange 22 and base plate 24 increases the surface area of the interface and potentially distributes the load of adjustment mechanism 20 with an external structure.

Fasteners 48, 62 and 68 are fasteners that are appropriate for use with the material with which they interface. For example, fasteners 48, 62 and 68 are preferably hardened screws for connecting to concrete, but the fasteners can also include attaching nuts and other connecting devices depending upon the application. Similarly, anchor bolt 42 is a hardened bolt that preferably includes a retention aiding device that is embedded in concrete 38. The fasteners, to include fasteners 26, 32 and bolt 42 of adjustable column 10, have the load capacity to perform the desired functions defined herein.

Referring now to FIG. 1 adjustable column 10 can be assembled and installed advantageously by a single unskilled worker as an apparatus that includes column 12, cap plate 18 and adjustment mechanism 20. Select components such as cap plate 18, base flange 22 and/or base plate 24, for example, can be manufactured and assembled in the field as adjustable column 10.

Figure 5:
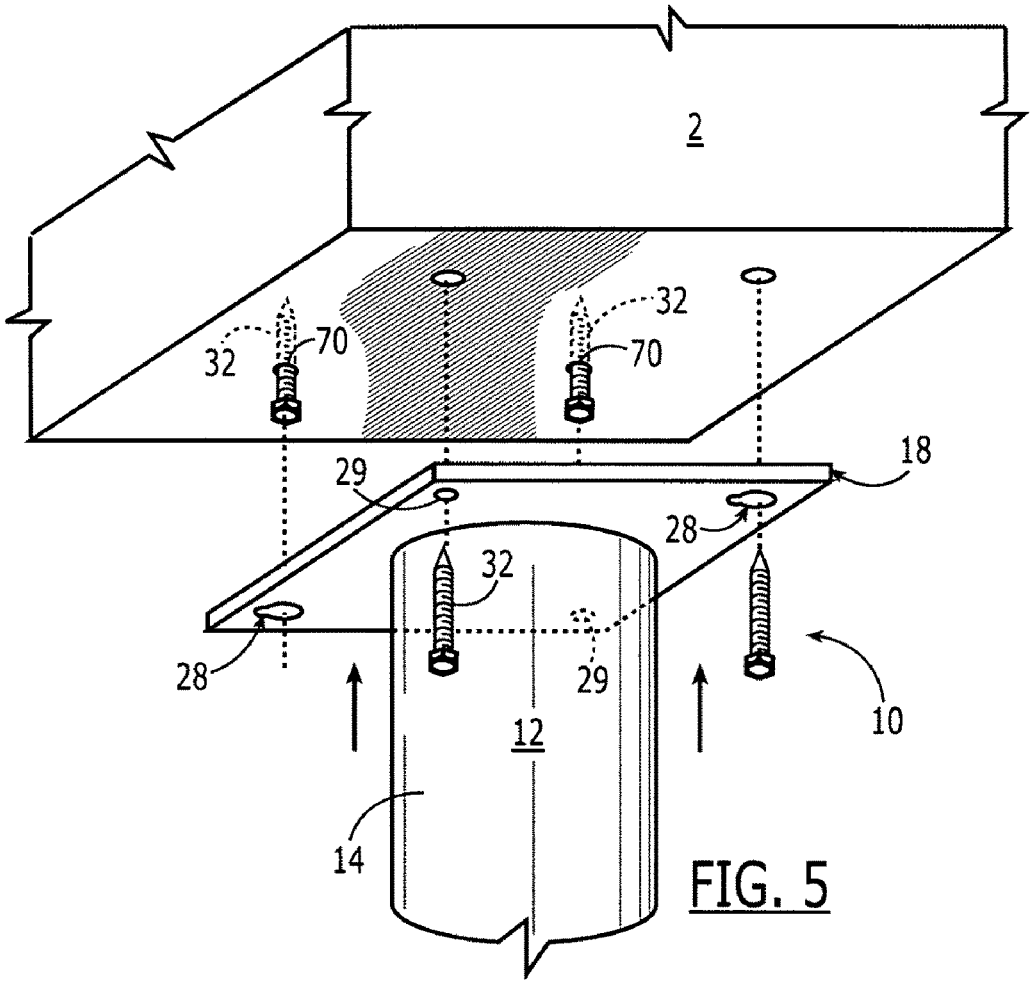
FIG. 5 is a front and upwardly directed perspective view of the connecting of the adjustable column of FIG. 1 to an external beam.

As shown in FIGS. 2 and 5, cap plate 18 is preferably operationally employed as a template and two apertures 70 are made in an external structure such as beam 2 that are aligned with key hole apertures 28. At least two fasteners 32 are screwed into beam 2 and a gap is left between the heads of fasteners 32 and beam 2 that can receive the thickness of cap plate 18. Beam 2 is made of industry standard materials such as wood, wood products, concrete or steel and due to their varying materials it is understand that there are application specific alternative processes for connecting a support structure, such as fasteners 32, to beam 2 for the suspension of column 12. Some of these alternative support structures for beam 2 can include, for example, a metal strap, drilling holes and using standard fastener mechanisms such as bolts and nuts, welding or an adapter plate, for example, that has fasteners that connect to cap plate 18 as well as other alternative mechanical connection means.

Nut 30 is connected to anchor 42 in first end portion 14 to secure cap plate 18 to column 12. Nut 30 recesses into aperture 40 defined in concrete filling 38. This connection advantageously provides a continuous load bearing interface between plate 18 and the terminal end of first end portion 14. The opposing side of cap plate 18 from nut 30 is adapted to interface with beam 2.

Referring now to FIGS. 3, 5 and 6, in the first embodiment of adjustment mechanism 20, base flange 22 is connected to second end portion 16. Fasteners 26 are threaded through apertures 50 and threaded into apertures 52 or positioned in notches 53. The height of adjustment mechanism 20 is adjusted by turning fasteners 26 that interface with notches 53 to change the height between base flange 22 and base plate 24. The height of distance between base flange 22 and base plate 24 is initially adjusted so that there is sufficient clearance between base plate 24 and a floor, such as a subfloor 4 or floor 6, to accommodate the raising and connecting of adjustable column 10. In this preferred embodiment this can also include leaving sufficient height clearance for a lever to be inserted under adjustable column 10. It is understood that the load capacity, size and number of fasteners 26 as well as the number of apertures 50, apertures 52 and notches 53 can vary depending upon an intended application of adjustable column 10.

Adjustable column 10 is then raised and temporarily held in an approximately vertical position aligned with fasteners 32 in beam 2. A lever is positioned under adjustment mechanism 20 and actuated to raise adjustable column 10 to pass the heads of preferably two fasteners 32 through the first portions of key hole apertures 28 of cap plate 18. Adjustable column 10 is repositioned to secure the heads of fasteners 32 in the second portion of key holes 28. As required, a safety plug or adapter can be additionally inserted into the first portions of key hole 28 to ensure that adjustable column 10 does not shift during the installation process. Adjustable column 10 is then freely hanging from the connection of fasteners 32 with beam 2. Additional fasteners 32 are employed through the remaining apertures 28 and/or 29 of cap plate 18 to secure adjustable column 10 to beam 2 at a desired alignment.

In this preferred embodiment utilizing four fasteners 26, a first pair of diagonally opposed fasteners 26 is threaded into apertures 50 of base flange 22 and into threaded apertures 52 of base plate 24. The first pair of fasteners 26 preferably terminates in apertures 52. The remaining pair of diagonally opposed fasteners 26 is threaded through apertures 50 and each fastener 26 terminates in its respective notch 53 of base plate 24. The second pair of fasteners 26 is employed to move base plate 24 relative to base flange 22 and into direct contact with sub-floor 4 and place adjustable column 10 into a load bearing position between beam 2 and sub-floor 4. Base plate 24 can also be adjusted to compensate for minor slope variations in sub-floor 4.

Attachment mechanism 20 is secured to subfloor 4 by connecting fasteners 48 through apertures in base plate 24 to secure adjustable column 10 to subfloor 4. Fasteners 26 that include a concrete screw second end portion can be optionally extended through apertures 52 and into pre-drilled apertures in subfloor 4 to provide additional uplift protection. Once adjustable column 10 is fixed in a load bearing position between beam 2 and subfloor 4, concrete floor 6 is poured to encase adjustment mechanism 20. The encasing of adjustment mechanism 20 includes the area between plates 22 and 24 and preferably overlays fasteners 26 below the floor level. The encasing of adjustment mechanism 20 advantageously provides additional uplift protection, sets adjustable column 10 at a permanent height and precludes tampering.

In an alternative embodiment of attachment mechanism 20, base flange 22 is connected to second end portion 16. Adjustable column 10 is raised vertically and connected to beam 2 as described previously by a single person. In this preferred embodiment, base plate 24 is positioned on subfloor 4 and the four fasteners 26 are threaded through apertures 50 of base flange 22 and each fastener 26 is aligned with a notch 53. Fasteners 26 are extended into notches 53 to adjust the height of adjustable column 10 and positioning adjustable column 10 in a load bearing position by moving base flange 22 relative to base plate 24. Uplift protection is provided by band 54 that is positioned under base plate 24 and connects to base flange 22 as described previously. Additional fasteners can extend through base plate 24 and/or base plate and band 54 to connect adjustment mechanism 20 to subfloor 4 to provide uplift protection. Adjustment mechanism 20 is then overlaid with floor 6 as described above.

Alternatively, base plate 24 of adjustment mechanism 20 can be positioned on and secured directly to floor 6. In this application, the gap between plates 22 and 24 is filled with grout. Adjustment mechanism 20 can be further encased in concrete, as desired. As noted above, fasteners 48 are employed through apertures in base plate 24 and directly into floor 6 to provide uplift protection.

Figure 7:
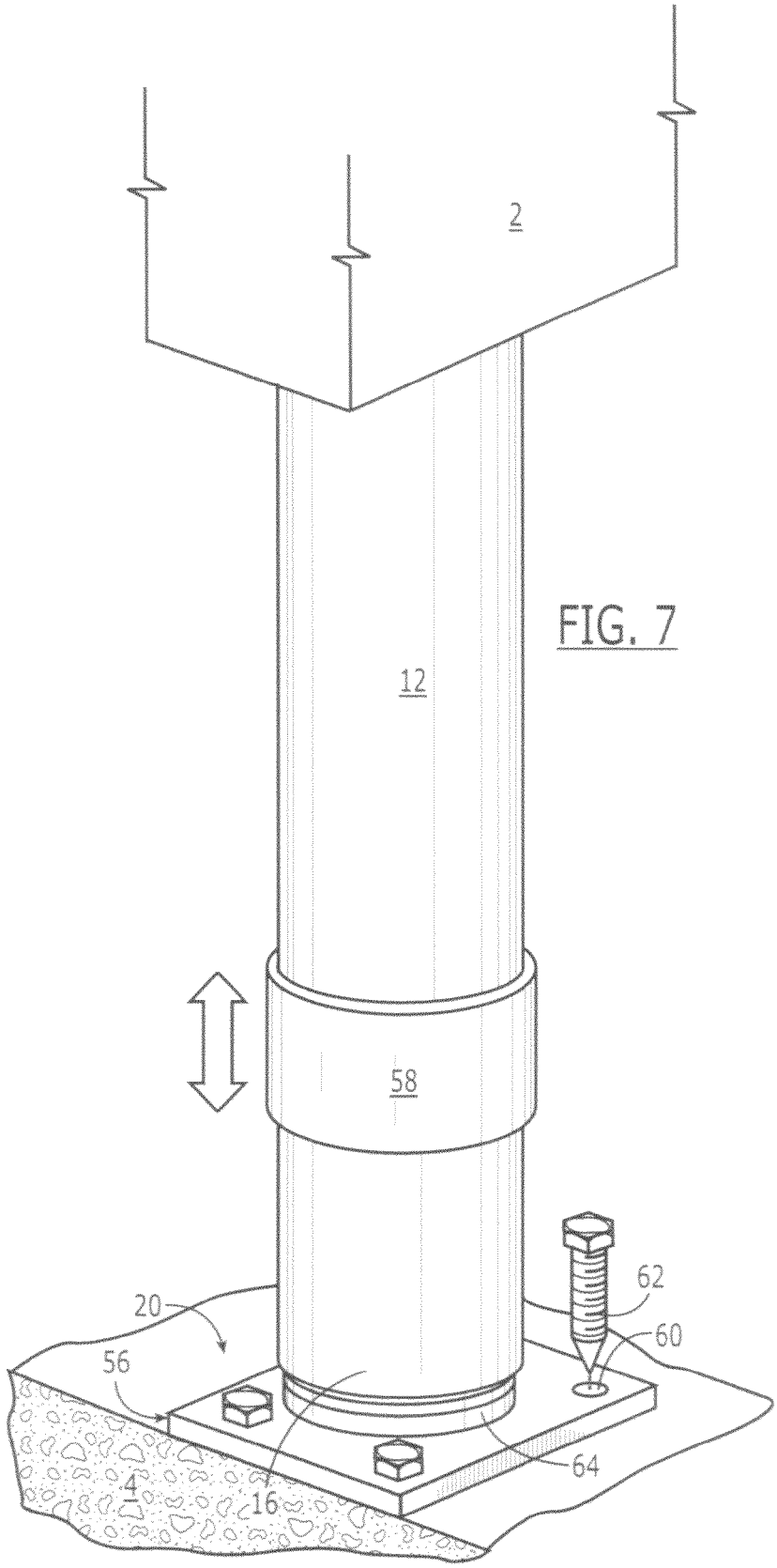
FIG. 7 is a front and downwardly directed perspective view of the adjusting of the height of the adjustable column and adjustment mechanism of FIG. 4 into a load bearing position.

As shown in FIGS. 4, 5 and 7, the operational employment of the second embodiment of adjustment mechanism 20 of adjustable column 10 includes the alignment of cap plate 18 and base plate 56. Cap plate 18 is secured to column 12 and fasteners 32 to beam 2. Sleeve 58 is slidingly connected onto column 12. Adjustable column 10 is raised approximately vertical and connected to beam 2 as described previously. Base plate 56 is aligned with column 12 and secured onto subfloor 4 by connecting fasteners 62 into subfloor 4 through apertures 60 of base plate 56.

Figure 8:
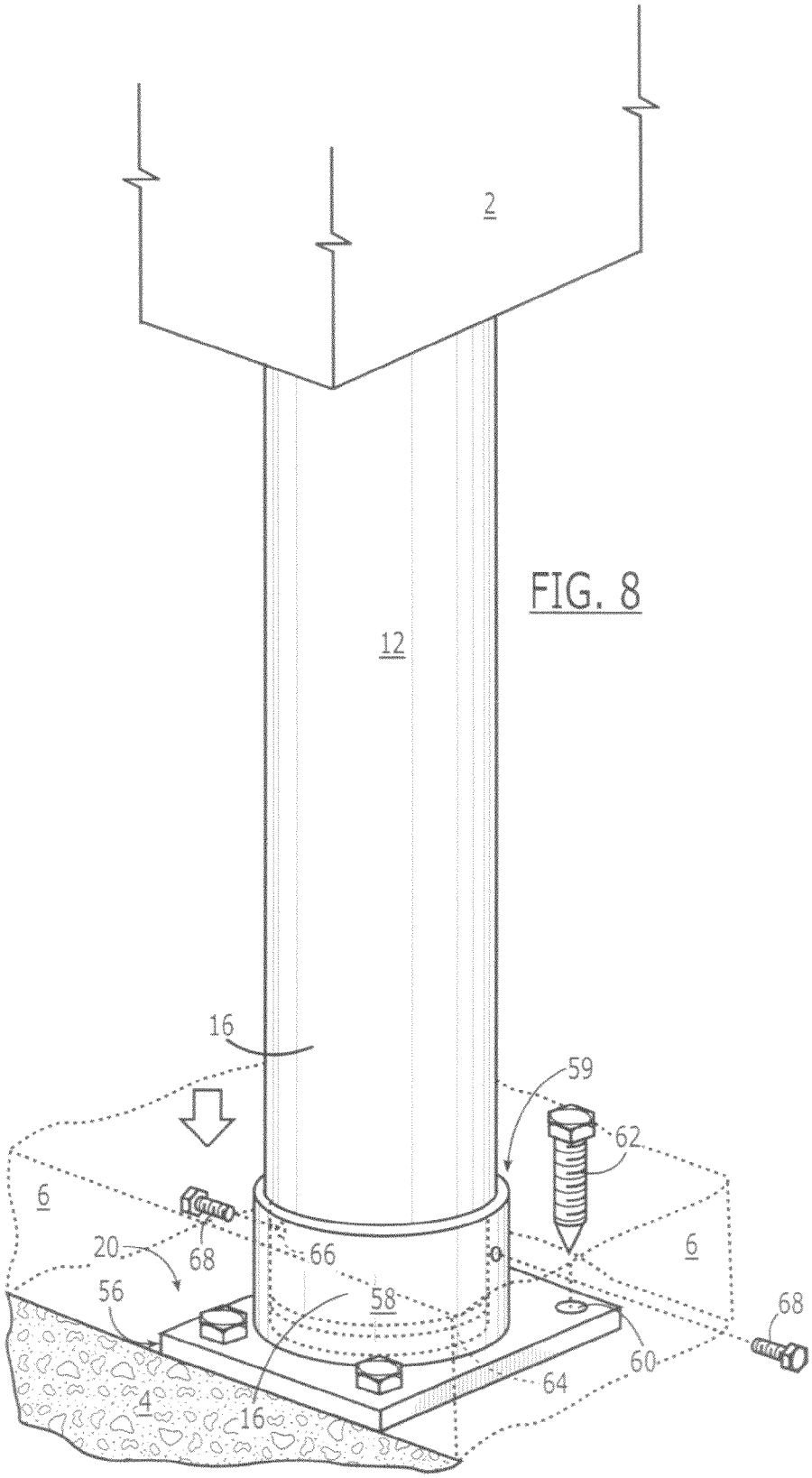
FIG. 8 is a front and downwardly directed perspective view of the adjustable column and adjustment mechanism of FIG. 7 in a load bearing position.

Referring now to FIGS. 7 and 8, one or more individual discs from set of discs 64 are selectively inserted to fill the gap between base plate 56 and the terminal end of second end portion 16 of column 12. The set of discs 64 is aligned with column 12 and sleeve 58 is slid down column 12 and connected with base plate 56. The means of connection between sleeve 58 and flange 56 can be a permanent coupling such as welded joint or alternatively a removable connection such as a threaded or a bolted interface. Specific examples of equivalents include a flange 56 that has an outer sleeve secured with fasteners to sleeve 58 or a sleeve 58 that includes a flange aligned with flange 56 and apertures that receive two or more concrete screws, such as concrete screws 64 that connect sleeve 58 to at least flange 56.

In the preferred embodiment, fasteners 68 connect column 12 and sleeve 58 through apertures 66. The apertures in column 12 that receive fasteners 68 can be one of a plurality of apertures that are predrilled in column 12 or apertures that are drilled on site during installation. The second embodiment of adjustment mechanism 20 can then be selectively encased in concrete to provide additional uplift protection and preclude tampering.

In the preceding specification, the present disclosure has been described with reference to specific exemplary embodiments thereof. It will be evident, however, that various modifications, combinations and changes may be made thereto without departing from the broader spirit and scope of the invention as set forth in the claims that follow. For example adjustment mechanism 20 can include alternative means for adjusting the height of column 12 such as a single threaded load bearing connector that couples with threaded connectors on base flange 22 and base plate 24 to adjust the height of adjustable column 10.

What is claimed is:

1. An adjustable lally column that comprises:

a lally column that has a first end portion and an opposed second end portion;

a cap plate that has a first side that connects to the first end portion and an opposed side that is adapted to connect to a beam, a cap plate fastener connects the cap plate and the lally column, the cap plate includes a selective retention mechanism for connecting the cap plate to the beam, the selective retention mechanism includes apertures in the cap plate that vary in cross-section area and a support structure adapted to connect to the beam, each aperture of the selective retention mechanism has a first portion that has a first cross-sectional area and a second portion that has a second cross-sectional area, the first cross-sectional is larger than the second cross-sectional area, the support structure includes fasteners that have a head and a shaft, the shaft has a first cross-sectional area that is less than the cross-sectional area of the head, the fasteners align with the apertures of the selective retention mechanism of the cap and adapted to connect to the beam, the heads of the fasteners receive the first portions of the apertures, the fasteners aligned with second portion of the apertures, the selective retention mechanism adapted to retain the cap plate in a suspended position from the beam, an adjustment mechanism that connects to the second end portion of the column and includes a base plate, the base plate adapted to be positioned on a floor, the adjustment mechanism extendable between the second portion and the floor, the adjustment mechanism adapted to position the suspended cap plate and lally column in a load bearing position between the beam and floor.

2. The adjustable lally column of claim 1, wherein the support structure is a fastener that is a bolt and the bolt is adapted to connect to the beam.

3. The adjustable lally column of claim 1, wherein the adjustment mechanism aligned with the lally column and the base plate adapted to secure to the floor and aligned with the lally column in the suspended position.

4. The adjustable lally column of claim 1, wherein the adjustment mechanism includes a base flange that connects to the second end portion and at least one threaded fastener adjusts the distance between the base plate and the base flange and provides a load bearing interface between the base flange and base plate.

5. The adjustable lally column of claim 1, wherein the adjust mechanism includes a base flange and a plurality of threaded fasteners, at least two threaded fasteners connect the base flange and base plate and at least two threaded fasteners adjust the distance between the base flange and the base plate.

6. The adjustable lally column of claim 1, wherein at least one threaded fastener extends through the base plate and the at least one fasteners adapted to connect to the floor.

7. The adjustable lally column of claim 1, wherein uplift protection is provided by fasteners that extend through apertures in the base plate and fasteners adapted to extend into the floor and fasteners that extend through the apertures in the cap plate and adapted to extend into the beam.

8. The adjustable lally column of claim 1, wherein the adjustment mechanism is connected to the cap plate and column in the suspended position and the adjustment mechanism extends from the second portion to the floor to position the column and cap plate in the load bearing position between the beam and the floor.

9. The adjustable lally column of claim 1, wherein the support structure adapted to connect to the beam and retain the cap plate in the suspended position from the beam, the lally column connected to the cap plate in the suspended position.

10. The adjustable lally column of claim 1, wherein the additional fasteners includes fasteners adapted to secure the cap plate in position to the beam at the desired alignment.

11. The adjustable lally column of claim 1, wherein the adjustment mechanism includes a base flange and a plurality of threaded fasteners, at least one threaded fastener connects the base flange and base plate and at least two threaded fasteners adjust the distance between the base flange and the base plate.

12. The adjustable lally column of claim 1, wherein the adjustment mechanism includes a base flange and a plurality of threaded fasteners, at least two threaded fasteners adjust the distance between the base flange and the base plate.

* * * * *